US006176026B1

(12) United States Patent
Leung

(10) Patent No.: US 6,176,026 B1
(45) Date of Patent: Jan. 23, 2001

(54) STEAM IRON WITH POWER AND WATER SUPPLYING STAND

(75) Inventor: Chi-Wah Leung, Chai Wan (HK)

(73) Assignee: Simatelex Manufactory Co., Ltd., Hong Kong (HK)

( * ) Notice: Under 35 U.S.C. 154(b), the term of this patent shall be extended for 0 days.

(21) Appl. No.: 09/372,510

(22) Filed: Aug. 11, 1999

(51) Int. Cl.[7] ..... D06F 79/02
(52) U.S. Cl. ..... 38/96; 38/77.6
(58) Field of Search ..... 38/77.3, 77.6, 38/79, 96, 245, 246, 247, 250, 256, 259

(56) References Cited

U.S. PATENT DOCUMENTS 2,777,226 * 1/1957 Finlayson ..... 38/77.6
5,315,773 * 5/1994 Iwami et al. ..... 38/107 X

FOREIGN PATENT DOCUMENTS

2307500 * 12/1990 (JP) ..... 38/77.83
5200196 * 8/1993 (JP) ..... 38/77.6
6105997 * 4/1994 (JP) ..... 38/77.6

* cited by examiner

*Primary Examiner*—Ismael Izaguirre
(74) *Attorney, Agent, or Firm*—Jackson Walker L.L.P.

(57) ABSTRACT

A cordless steam iron is provided with an external reservoir assembly for automatically re-filling an internal reservoir when the iron rests on an iron stand. The reservoir assembly includes a removable bottle that can be readily filled with water and then placed upside down in a water container. A valve automatically maintains the water level in the container (and the internal reservoir) to a desired maximum level see chain-dotted line A. Water valves cooperate with one another and open automatically when the iron is placed on the stand, to allow water to flow from the container to the reservoir.

6 Claims, 5 Drawing Sheets

STEAM IRON WITH POWER AND WATER SUPPLYING STAND

BACKGROUND OF THE INVENTION

1. Field of the Invention

The invention relates more particular to a steam iron for use with an external water reservoir and water feeding unit.

2. Description of Prior Art

One disadvantage of a steam iron is the small capacity of an inside water reservoir that limits the operation time of the iron. Consequently the user has to frequently interrupt ironing in order to refill water into the reservoir. Although the frequency of refilling could be reduced by employing a larger inside water tank, this makes the iron heavier and bulky and hence more difficult for the user to manipulate.

Some steam irons employ a large separate external water reservoir which is connected by a flexible hose to provide either water or steam to an iron body. This arrangement permits a large capacity reservoir that is particularly useful in lengthy ironing sessions and the user does not have to fill the reservoir while ironing. However, the necessary robust flexible water hose connected between the external reservoir and the iron will significantly restrict freedom of movement of the iron. The large external water reservoir is usually not detachable for convenient refilling with water under a tap, for example. Thus, the user needs to use a separate water container for filling the large external water reservoir. In addition, the user is required to carry the whole unit to a sink for disposing of any remaining water after use.

SUMMARY OF THE INVENTION

It is an object of the invention to overcome or to at least reduce these problems.

According to the invention there is provided a steam iron arrangement having an iron with an internal water reservoir, a stand on which the iron can rest when not in use for ironing; an electrical supply means, an external water reservoir assembly adjacent the stand, and a cooperating water valve on each of the iron and the stand that close off when the iron is removed from the stand and automatically open to allow water to flow from the external water reservoir to the internal water reservoir through the valves whenever the iron is placed to rest on the stand.

A flow valve is preferably mounted in the external reservoir that closes off automatically whenever a water level in the internal reservoir reaches a maximum predetermined desired level.

The external reservoir assembly may comprise a bottle having an upper detachable sealably lid incorporating a flow valve, the bottle being arranged to fit upside down in the external reservoir so that water can flow out of the bottle into the external reservoir through the lid, in which the flow valve automatically closes when the level in the reservoir reaches a maximum predetermined desired level.

The cooperating valve means may each include a resilient water connector, the connectors being arranged to face and seal together when the iron is placed on the stand before the valves are opened.

Each valve means may comprise a biassed operating rod, the rods being arranged to face and to be pressed against one when the iron is placed on the stand and so be urged against their biassing to open the valve means.

BRIEF DESCRIPTION OF THE DRAWING

A cordless steam iron apparatus according to the invention will now be described by way of example with reference to the accompanying drawings in which.

DESCRIPTION OF THE PREFERRED EMBODIMENTS

Figure 1:
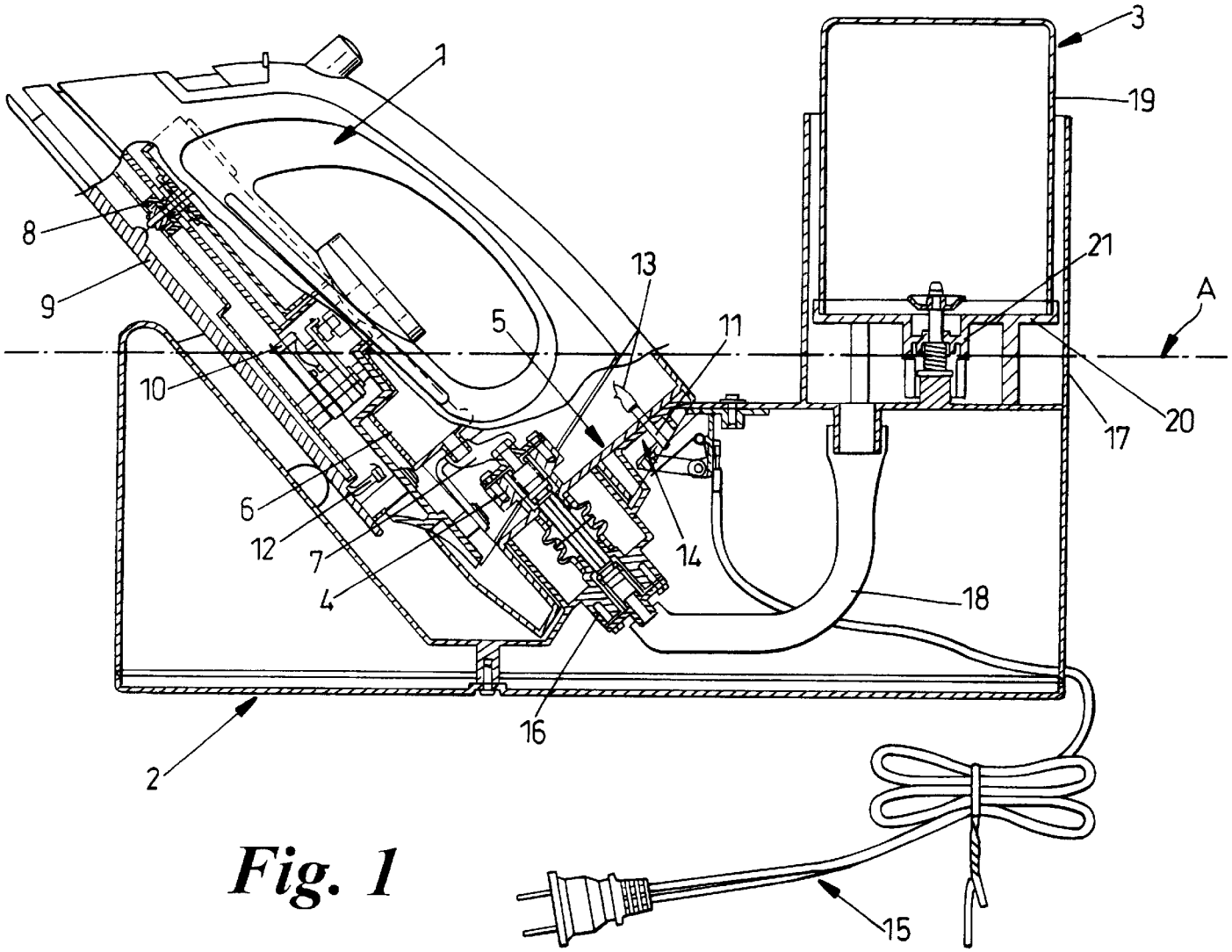
FIG. 1 is a schematic partially sectioned elevation of the apparatus.

Referring the drawings, FIG. 1 shows an iron 1 detachably mounted on an iron stand 2 and a detachable external reservoir assembly 3. The detachable iron 1 includes a first water feeder valve 4 on a rear cover 5 which is connected to an internal reservoir 6 by a flexible tube 7. A controlling valve 8 controls water inside the internal reservoir 6 to feed onto a soleplate 9 to generate steam. An adjustable thermostat 10 is mounted on the soleplate 9 for controlling the temperature of the soleplate 9 by cutting off power supplied from electrical pins 11 to a heating element 12 through electrical wiring 13 whenever the soleplate reaches a desired temperature in known manner.

The iron stand 2 includes a power socket 14 which is connected to a power cord 15. A second water feeder valve body 16 is connected to a water feeder container 17 by a flexible tube 18.

Figure 2:
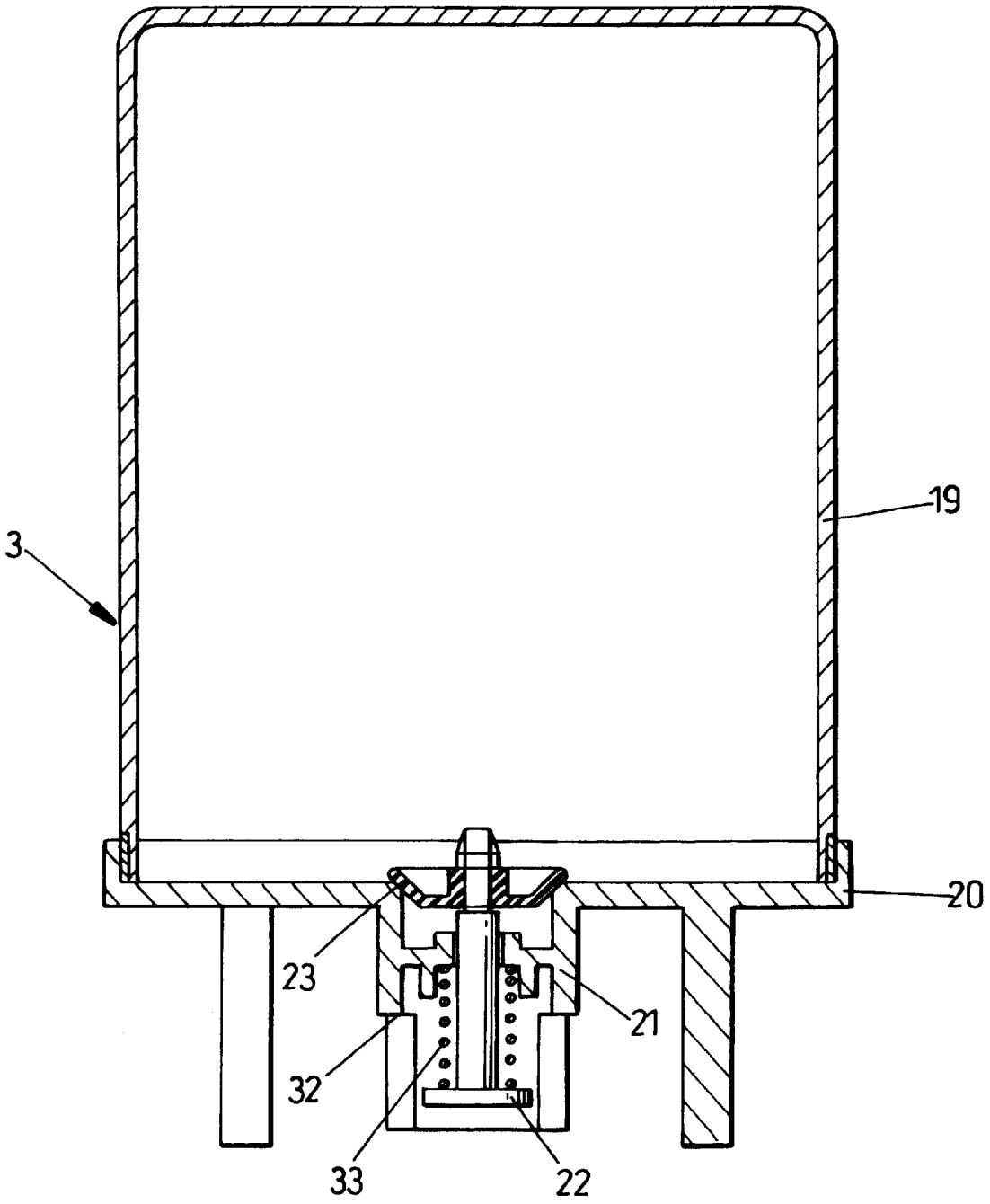
FIG. 2 is an enlarged sectional view of a reservoir valve located in an external reservoir assembly.

Referring to FIG. 2, the external reservoir assembly 3 includes a separable reservoir or bottle 19 which has a removable sealable lid 20. A flow valve 21 is located below the lid 20 and a slot 32 is provided adjacent the end of the valve. A spring 33 applies a compression force to push a flow valve actuator 22 and a valve seal 23 downwards to close the valve and prevent water leakage from the bottle 20 into the container 17. The bottle 19 can be separated from the iron stand 2 and the lid cover 20 opened to fill the bottle with water. The lid 20 is closed after filling with water and the bottle turned up-side-down and placed in a container 17. The container 17 is located and mounted adjacent a side or end of the iron stand 2.

When the valve actuator 22 in the reservoir valve 21 pushes against a pin on the bottom of the container 17, the reservoir valve seal 23 moves upwards and water inside the bottle 19 flows into the container 17. Water feeds from there into the internal reservoir 6 through the flexible tube 18, the feeder valves 16, and the flexible tube 7. When the water inside the feeder container 17 rises to the level that blocks the slot 32 on the outlet tube of the reservoir valve body 21, air cannot then enter inside the bottle 19 and so water stops flowing out. Thus the water level in the container 17 remains at a certain level (see chain-dotted line A in FIG. 1). The water level inside the internal reservoir 6 reaches to the same level and represents the desired maximum water level for the internal reservoir 6. When ironing is finished the bottle 19 can be easily removed and emptied into a sink as desired.

Figure 3A:
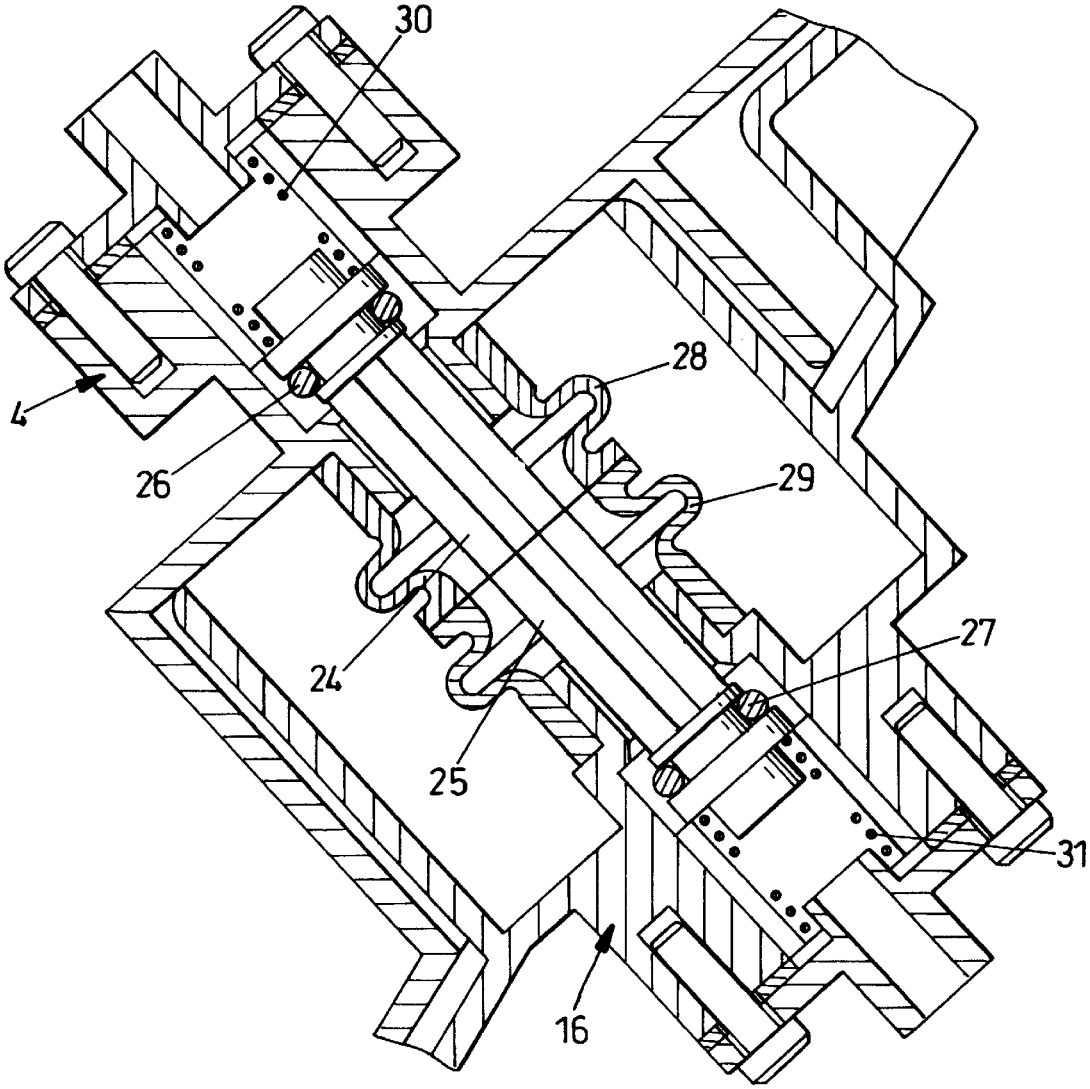
FIG. 3*a* is an enlarged sectional view of a first water feeder valve on a rear cover of the iron and a second water feeder valve on an iron stand when an iron is resting on the iron stand.

Referring to FIG. 3*a*, a flexible water inlet connector 28 is located at the end of the water feeder valve 4 and seals against a flexible like water outlet connector 29 mounted on the iron stand 2. The connectors 28 and 29 are held firmly and sealingly together due to their relative location and the weight of the iron 1 pressing downwards when the iron rests on the iron stand 2.

Figure 3B:
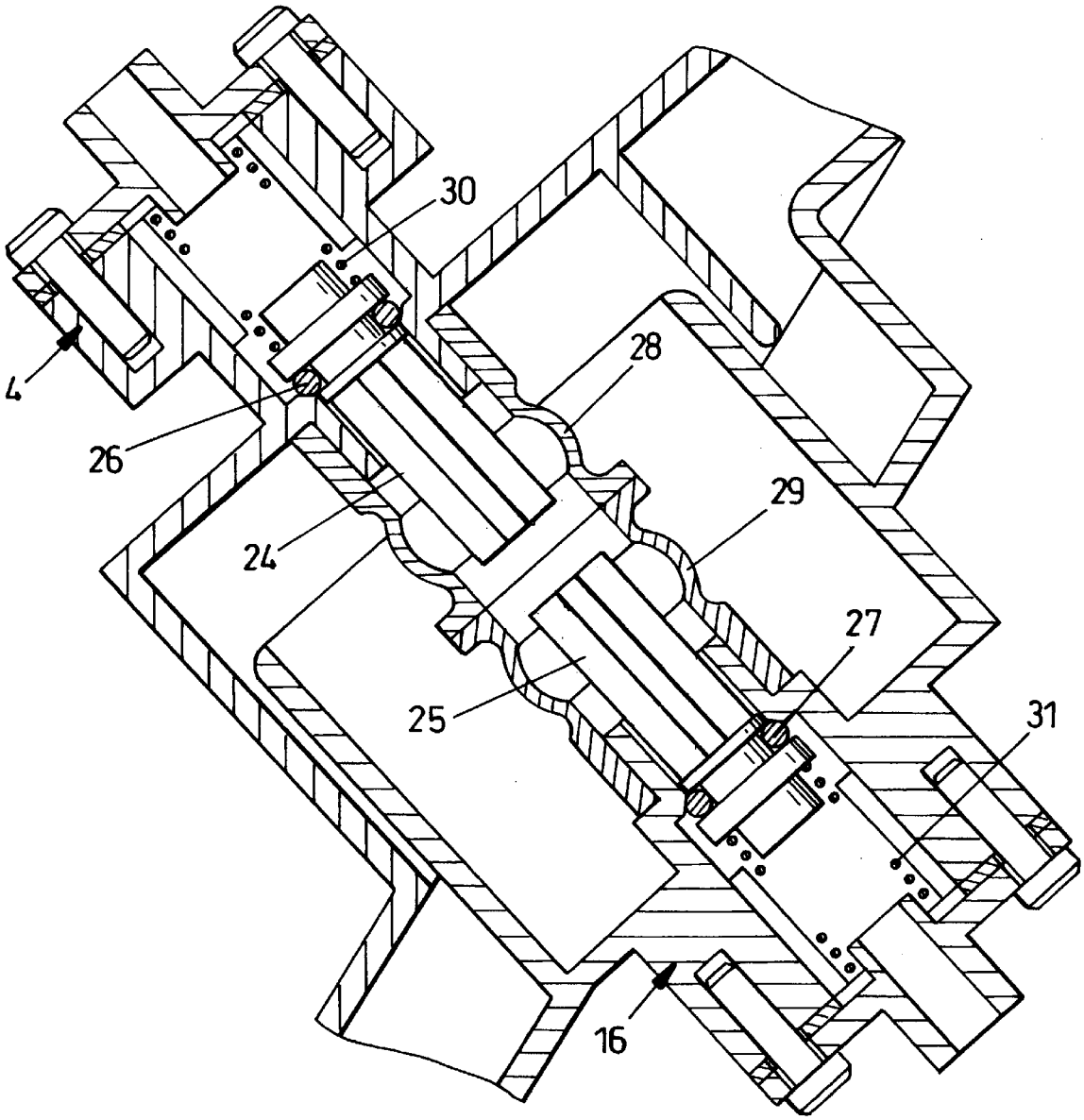
FIG. 3*b* is an enlarged scale sectional view of the first water feeder valve and the second water feeder valve when the iron is detaching from the iron stand.
Figure 3C:
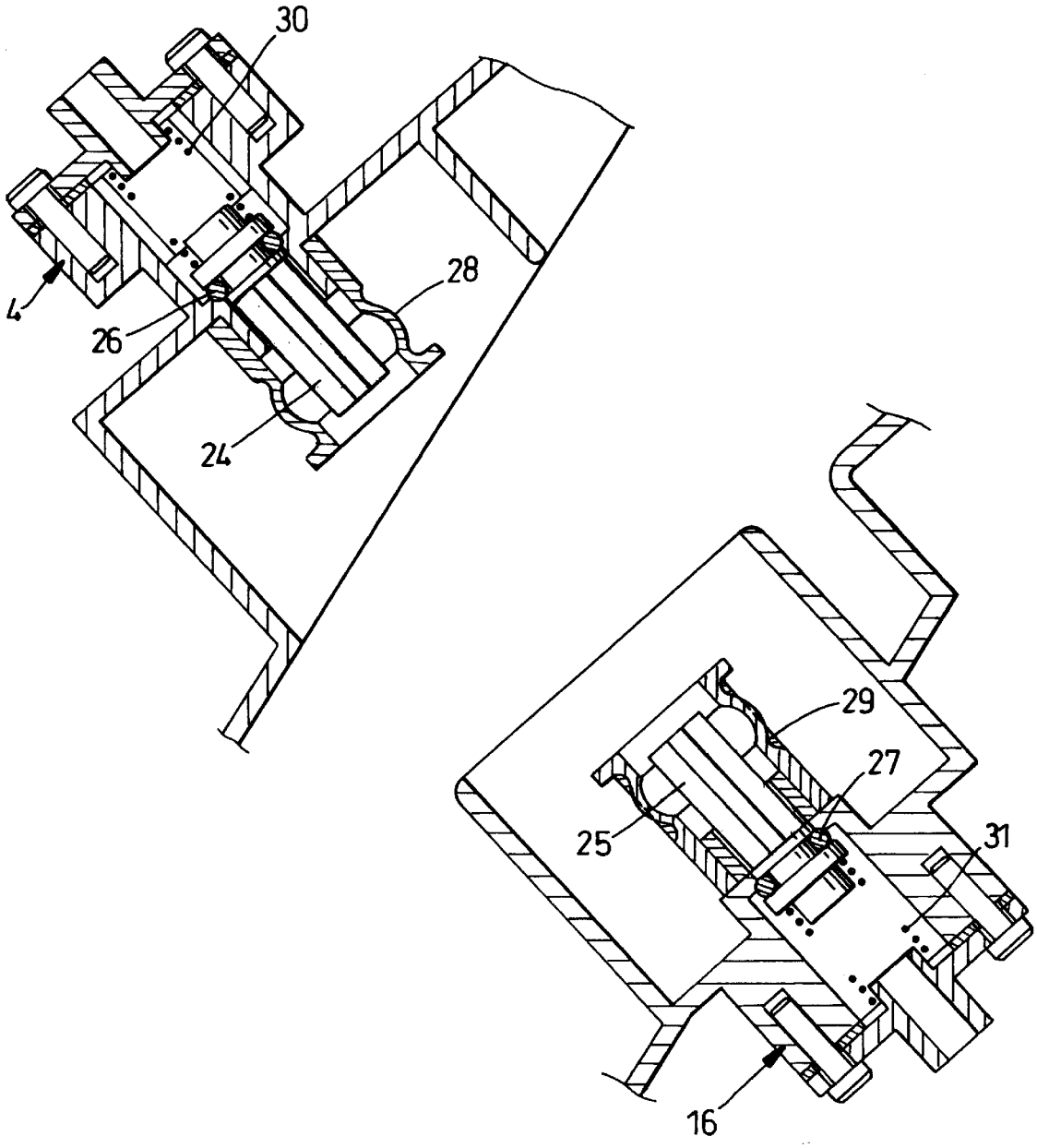
FIG. 3*c* is an enlarged scale sectional view of the first water feeder valve and the second water feeder valve when the iron is fully separated from the iron stand.

Referring to FIG. 3*b*, when detaching the iron 1 from the iron stand 2 for ironing, a feeder valve actuator 24 and an iron stand feeder valve actuator 25 are pushed outward by springs 30 and 31, and valve gaskets 26 and 27 seal off the valves 4 and 16 respectively. The two end surfaces of the valve outlet connectors 28 and 29 remain in contact with each other, to prevent water spillage, until the valves 4 and 16 are closed. These valves are fully closed when the valve outlet connector 28 is separated from the feeder valve outlet connector 29 to prevent water flow out of the internal reservoir 6 and out of the container 17, as shown in FIG. 3*c*.

It will be appreciated that the reservoir 6 normally has an upper bleed hole to atmosphere to permit water flow out of the reservoir 6 onto the soleplate 9. Thus, the described "automatic" control of water filling is normally required to prevent the water level in the internal reservoir from rising too high and water leaking out of the bleed hole. It will be noted that the any small spillage that may occur will take place below electrical pins 11 so spillage water cannot flow towards the pins 11.

To reheat the soleplate 9 and to refill water into the internal reservoir 6, the iron 1 is placed onto the iron stand 2. As the iron moves towards its vest position, the connectors 28 and 29 first contact against one another to provide a water sealing function. The valve actuators 24 and 25 then contact each other and the valves open. Water inside the container 17 flows into the internal reservoir 6 and stops flowing automatically when the water level reaches the maximum water level (see chain-dotted line A in FIG. 1). The valves 4 and 16 will remain open due to the weight of the iron 1. At the same time electrical pins 11 will mate with the power socket 14 to allow power to flow to the soleplate 9 in an otherwise conventional manner.

It will be appreciated that the iron may be provided with a power supply cable that is permanently fitted to the rear cover 5 in well-known manner. That means that the iron is not "cordless", however the fixed power cables (although the power cable could be manually unpluggable from the cover) are usually quite flexible and lightweight and so do not interfere too much otherwise with normal manipulations of the iron during use. Thus, while it is often preferable to have the electrical power connections that make and break automatically when the iron is placed on and removed from the stand 2, it is not essential and embodiments of the invention include irons in which an electrical power cable is fixed to the iron cover to supply power to the soleplate 9 as required.

I claim:

1. A steam iron arrangement having an iron with an internal water reservoir, a stand on which the iron can rest when not in use for ironing; electrical supply means, an external water reservoir assembly adjacent the stand, and a cooperating water valve on each of the iron and the stand that close off when the iron is removed from the stand and automatically open to allow water to flow from the external water reservoir to the internal water reservoir through the valves whenever the iron is placed to rest on the stand, in which the cooperating valve means each include a resilient water connector with an end surface, the connectors being arranged to cooperate and the end faces to seal against one another as the iron is placed on the stand before the valves are opened.

2. A steam iron arrangement according to claim 1, including a flow valve mounted in the external reservoir that closes off automatically whenever a water level in the internal reservoir reaches a maximum predetermined desired level.

3. A steam iron arrangement according to claim 1, including an external reservoir assembly comprising a bottle having an upper detachable sealably lid incorporating a flow valve, the bottle being arranged to fit upside down in the external reservoir so that water can flow out of the bottle into the external reservoir through the lid, in which the flow valve automatically closes when the level in the reservoir reaches a maximum predetermined desired level.

4. A steam iron arrangement according to claim 1, in which the cooperating valve means each include a resilient water connector, the connectors being arranged to face and seal together when the iron is placed on the stand before the valves are opened.

5. A steam iron arrangement according to claim 1, in which each valve means comprises a biassed operating rod, the rods being arranged to face and to be pressed against one when the iron is placed on the stand and so be urged against their biassing to open the valve means.

6. A steam iron arrangement according to claim 1, in which the electrical supply means includes contacts on the iron and on the stand that are arranged to automatically mate one another when the iron rests on the stand.

* * * * *